US007231762B2

(12) United States Patent
Bassani

(10) Patent No.: US 7,231,762 B2
(45) Date of Patent: Jun. 19, 2007

(54) EXHAUST MANIFOLD FLANGE

(75) Inventor: Darryl C. Bassani, 5729 Grandview, Yorba Linda, CA (US) 92886

(73) Assignee: Darryl C. Bassani, Anaheim, CA (US)

( * ) Notice: Subject to any disclaimer, the term of this patent is extended or adjusted under 35 U.S.C. 154(b) by 123 days.

(21) Appl. No.: 10/787,063

(22) Filed: Feb. 25, 2004

(65) Prior Publication Data

US 2005/0262836 A1 Dec. 1, 2005

(51) Int. Cl.
*F01N 7/00* (2006.01)
*F02B 27/02* (2006.01)

(52) U.S. Cl. ..... 60/323; 60/313

(58) Field of Classification Search ..... 60/323, 60/313, 285
See application file for complete search history.

(56) References Cited

U.S. PATENT DOCUMENTS 2,694,583 A * 11/1954 Kintz et al. ..... 285/125.1
3,177,649 A * 4/1965 Tromel ..... 60/322
3,875,744 A * 4/1975 Brooks et al. ..... 60/313
3,926,539 A 12/1975 Lamm
4,083,570 A 4/1978 Sugawara
4,234,638 A 11/1980 Yamazoe et al.
4,373,329 A 2/1983 Martini
4,417,733 A * 11/1983 Usher ..... 264/239
4,423,544 A 1/1984 Kashmerick et al.
4,463,959 A 8/1984 Usher et al.
4,465,287 A 8/1984 Bindel et al.
4,512,148 A * 4/1985 Jacobson ..... 60/321
4,516,782 A 5/1985 Usher
4,519,619 A 5/1985 Doyle
4,591,170 A 5/1986 Nakamura et al.
4,705,278 A 11/1987 Locacius et al.
4,723,783 A 2/1988 Belter et al.
4,776,602 A 10/1988 Gallo
4,799,956 A 1/1989 Vogel
4,810,454 A 3/1989 Belter
4,822,062 A 4/1989 Gallo et al.
4,871,181 A 10/1989 Usher et al.
4,911,972 A 3/1990 Mercuri (Continued)

OTHER PUBLICATIONS

GrafTech International Ltd., Metal Reinforced Grafoil® Laminates Product Literature, 3 pp. (2003).

*Primary Examiner*—Thomas Denion
*Assistant Examiner*—Loren Edwards
(74) *Attorney, Agent, or Firm*—Knobbe Martens Olson & Bear, LLP

(57) ABSTRACT

An exhaust header having a recessed sealing surface that receives an annular graphite gasket for affecting a fluid tight seal. The exhaust header further includes one or more exhaust head pipe flanges and one or more exhaust head pipes. Each exhaust head pipe flange is fixedly attached to one of the exhaust head pipes to form a passageway through the exhaust header. During installation, each exhaust head pipe flange is aligned with a passageway from an exhaust port of an internal combustion engine. A one to one registration between the exhaust head pipe flanges and the exhaust ports is achieved. The gasket circumscribes the exhaust port when the exhaust header is aligned with the surface of the internal combustion engine. Torquing of one or more fasteners compresses the gasket against the surface of the internal combustion engine to form the fluid tight seal between the passageways of the exhaust port and the exhaust header.

11 Claims, 4 Drawing Sheets

SECTION B-B

U.S. PATENT DOCUMENTS 4,968,066 A * 11/1990 Adams ..... 285/142.1
5,144,800 A 9/1992 Shioya et al.
5,148,675 A * 9/1992 Inman ..... 60/321
5,152,259 A * 10/1992 Bell ..... 123/190.2
5,421,594 A 6/1995 Becerra
5,636,515 A * 6/1997 Matsumoto et al. ..... 60/323
5,944,322 A * 8/1999 Coff et al. ..... 277/594
6,087,034 A * 7/2000 Mercuri ..... 429/44
6,254,142 B1 * 7/2001 Kaifel et al. ..... 285/124.1
6,256,990 B1 * 7/2001 Itoh ..... 60/597

* cited by examiner 306
1.65
2.525

.75

222
.875
214
304
308
1.5
1.65

310
312
BOTTOM
TOP
.375

X

302

SECTION B-B

EXHAUST MANIFOLD FLANGE

BACKGROUND OF THE INVENTION

1. Field of the Invention

This invention relates generally to exhaust systems. More particularly, the invention relates to an exhaust header for an internal combustion engine.

2. Description of the Related Art

Within the exhaust system of an engine, gaskets are used to seal the interfaces between the connecting flanges of exhaust pipes, or between an exhaust header flange or other exhaust manifold and the cylinder head. In basic construction, these gaskets are conventionally formed from a sheet consisting of one or more layers of material. A plurality of apertures are formed in the sheet for registration with the passageways of the exhaust pipes or cylinder head and manifold. Bolts or other fasteners typically are employed to develop compressive forces within the interface for securing the assembly into an air tight joint.

Gaskets located between the header flange and the cylinder head may further include metallic material such as copper, steel, aluminum, or the like. Such a combination of a soft material along with a metallic material provides additional rigidity to the gasket. However, such conventional gaskets over time and under repeated thermal cyclings, may have a tendency to develop a compression set which, in turn, may result in a loss of torque within the fasteners and a loosening of the joint. Moreover, as no positive means typically is provided to limit or otherwise control the compression of the gasket, the gaskets may be overcompressed during an installation or maintenance which again leads to the development of a compression set within the gasket.

SUMMARY OF THE INVENTION

One aspect is an exhaust header for collecting exhaust gases from an internal combustion engine. The exhaust header comprises a plurality of flanges, each having a recessed sealing surface that is configured to circumscribe an exhaust port on an internal combustion engine and a plurality of graphite gaskets, each located in the recessed sealing surface and configured to form separate seals between each flange and the engine around the exhaust port. The exhaust header further comprises a plurality of head pipes in flow communication with the plurality of flanges and configured to route exhaust gases from the plurality of flanges and a collector having a plurality of inlet ports connected to the plurality of head pipes.

Another aspect is an apparatus configured to attach an exhaust pipe to an engine head to form an exhaust header for collecting exhaust gases from one or more exhaust ports from a cylinder of an internal combustion engine. The apparatus comprises a flange having a passageway extending therethrough, the flange further comprises a mating surface configured for attachment to a surface of the internal combustion engine. The flange further comprises a seal surface recessed below the mating surface, wherein the mating surface and the seal surface are configured to circumscribe a single exhaust port, and wherein the mating surface circumscribes the seal surface and a graphite gasket located on the seal surface and configured to form a seal between the surface of the internal combustion engine and the flange.

Another aspect is a method for installing an exhaust header to a substantially flat surface of a multi-cylinder engine, the exhaust header having a plurality of exhaust pipes, each exhaust pipe being configured to collect exhaust gas from a cylinder of the multi-cylinder engine. The method comprises providing an exhaust header having a plurality of flanges, each flange having a mating surface and a sealing surface, the sealing surface being recessed below the mating surface, wherein the mating surface and the sealing surface circumscribe an exhaust port from the cylinder and placing a graphite gasket against each sealing surface in the plurality of flanges. The method further comprises abutting each graphite gasket against a substantially flat surface of the multi-cylinder engine and individually compressing each graphite gasket against the substantially flat surface of the multi-cylinder engine so as to form a plurality of separate seals between the plurality of flanges and the substantially flat surface.

DETAILED DESCRIPTION OF THE PREFERRED EMBODIMENTS

The preferred embodiments of the present invention will now be described with reference to the accompanying figures, wherein like numerals refer to like elements throughout. The terminology used in the description presented herein is not intended to be interpreted in any limited or restrictive manner simply because it is being utilized in conjunction with a detailed description of certain specific preferred embodiments of the present invention.

User customization of exhaust components (such as headers) is common in the after-market. Customization allows the user to optimize the characteristics of their vehicle so as to maximize their own satisfaction. A successful customization leads to personal satisfaction of accomplishment and a feeling of attachment to the vehicle. Such customization is achieved by replacement of a component made by the original equipment manufacturer (OEM) with an after-market component. In the case of exhaust systems, incorporation of after-market components, for example, exhaust pipes, headers, mufflers, catalytic converters, crossover pipes, or other parts of the exhaust system, require the after-market component to integrate with an OEM component. For example, the replacement of an OEM exhaust manifold with an after-market exhaust header requires the after-market exhaust header to interface with a surface of the internal combustion engine of the vehicle. This surface may include certain design features, for example, steps, grooves, and attachment points, which impact the design of the after-market exhaust header.

Figure 1:
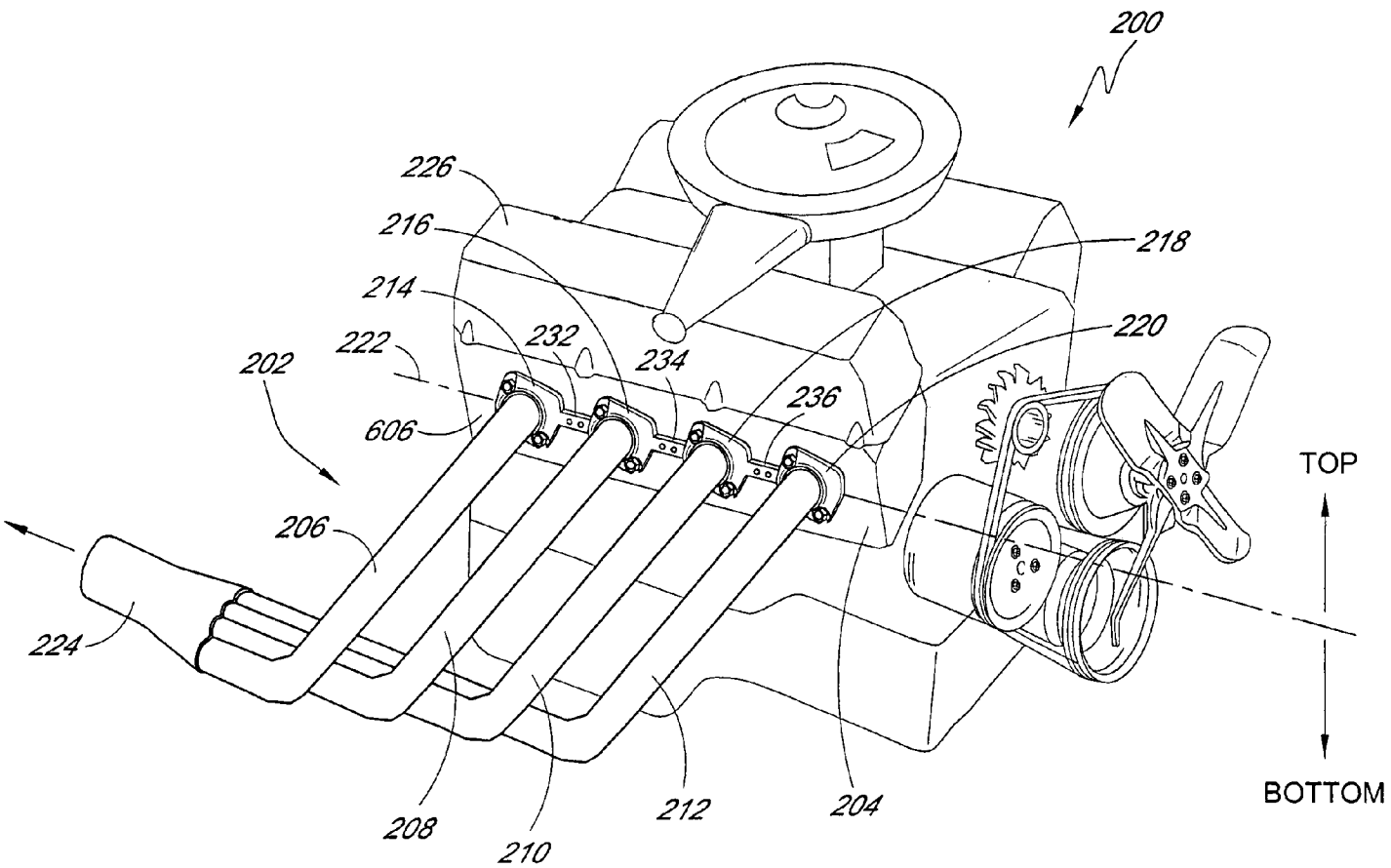
FIG. 1 is a perspective view of an internal combustion engine and an exhaust header component of the exhaust system attached thereto in accordance with the preferred embodiment of the present invention.

FIG. 1 is a perspective view of an internal combustion engine 200 and an exhaust header component 202 of an exhaust system attached thereto. The internal combustion engine 200 comprises, among other components known to one having ordinary skill in the art, a plurality of cylinders (not shown), with each cylinder having an intake port and an exhaust port. Air and fuel enter each cylinder through the intake port to form a mixture. After combustion of the mixture occurs, the combustion by-products are exhausted from the cylinder through the exhaust port. The combustion by-products or exhaust gases then enter an exhaust system. The exhaust system routes the exhaust gases a desired distance before expelling the exhaust gases from the vehicle.

In the embodiment of the invention shown in FIG. 1, the internal combustion engine 200 comprises eight cylinders in two banks of four cylinders each. The banks of cylinders are arranged in a V-configuration. Each of the cylinder banks is associated with and has fixedly attached a cylinder head 204. For ease of description, only the cylinder head 204 on the right or passenger side of the internal combustion engine 200 is described herein. However, as would be obvious to one having ordinary skill in the art, the following description equally applies to the left or driver side of the internal combustion engine 200. Moreover, features of the present invention can be used with internal combustion engines with different numbers of cylinders and different configurations of cylinders, or even rotary engines.

Returning to FIG. 1, the cylinder head 204 and the four cylinders together form four combustion chambers within the engine. Cylinder head 204 incorporates at least one intake port and at least one exhaust port for ingress and egress to each of the four cylinders. Each intake and exhaust port may include one or more valves which control the timing of flow into and out of the cylinders.

The geometry of the exhaust port opening at an exit plane of the exhaust ports can be, for example, oval, square, rectangular, round, or a combination thereof. Preferably, the inner geometry of the mating surfaces on the exhaust head pipe flanges are selected to match the geometry of the exhaust port at the exit plane. In this way, exhaust recirculation, backpressure, and thermal stresses induced by hot gas flow can be reduced. The exit angle of the exhaust gases leaving the exhaust ports relative to the exit plane of the exhaust ports can also be matched to the entrance angle into the exhaust header 202 to improve engine performance.

The exhaust header 202 comprises exhaust head pipe flanges 214, 216, 218, 220, exhaust head pipes 206, 208, 210, 212, webs 232, 234, 236 and collector 224. Located between the exhaust head pipe flanges 214, 216, 218, 220 and the cylinder head 204 are gaskets. The gaskets are described with reference to FIGS. 3–5. The exhaust header 202 provides individual passageways for the exhaust gases exiting the exhaust ports. The exhaust header 202 for the right or passenger side of the internal combustion engine 200 illustrated in FIG. 1 provides four individual passageways. Each passageway is formed by one exhaust head pipe flange 214, 216, 218, 220 and one exhaust head pipe 206, 208, 210, 212. In the embodiment of FIG. 1, the exhaust head pipe flange 214 is fixedly attached to the exhaust head pipe 206. The exhaust head pipe flange 216 is fixedly attached to exhaust head pipe 208. The exhaust head pipe flange 218 is fixedly attached to the exhaust head pipe 210. The exhaust head pipe flange 220 is fixedly attached to the exhaust head pipe 212.

The downstream ends of the exhaust head pipes 206, 208, 210, 212 are joined at collector 224. The collector 224 receives pulses of the exhaust gases from the internal combustion engine 200, then combines the pulses. Depending on the relative lengths of the four passageways through the exhaust header 202 and the timing of the exhaust valves, one or more pulses may arrive at the collector 224 together or as a series of pulses. The collector 224 provides the pulses to the portion of the exhaust system (not shown) that is downstream of the exhaust header 202. For example, the portion of the exhaust system that is downstream of the exhaust header 202 may include a pre-catalytic converter, a main catalytic converter, one or more mufflers, resonators, and exhaust pipes connecting therebetween.

The exhaust system may be in flow communication with exhaust pulses from the second bank of cylinders of the internal combustion engine 200. In such a configuration, the exhaust is combined via a crossover pipe or other such means to allow the combined pulses from one bank of cylinders to communicate with the combined pulses from a second bank of cylinders downstream of the collector 224. For simplicity purposes, the exhaust system downstream of the collector 224 is not shown.

The internal combustion engine 200 further comprises a valve cover 226 which forms a housing for one or more valve train components which are associated with the intake and/or exhaust ports in the cylinder head 204.

As illustrated in FIG. 1, the exhaust header 202 interfaces with the cylinder head 204 along surface 606. Each of the head pipe flanges 214, 216, 218, 220 independently interfaces with the surface 606. Webs 232, 234, 236 are located between each adjacent exhaust head pipe flange 214, 216, 218, 220. The web 232 connects the exhaust head pipe flange 214 with the exhaust head pipe flange 216. The web 234 connects the exhaust head pipe flange 216 with the exhaust head pipe flange 218. The web 236 connects the exhaust head pipe flange 218 with the exhaust head pipe flange 220. The webs 232, 234, 236 provide additional structural rigidity to the exhaust header 202. However, the webs 232, 234, 236 are not required to practice the invention. Alternatively, more than one web can be used to connect adjacent head pipe flanges 214, 216, 218, 220.

The pulses of exhaust gas exiting the cylinder head 204 enter the exhaust head pipes 206, 208, 210, 212 via the exhaust head pipe flanges 214, 216, 218, 220. The exhaust head pipes 206, 208, 210, 212 are preferably made from a metallic material, for example, aluminum or steel. For example, the exhaust head pipes 206, 208, 210, 212 can be made from 14-gauge steel with an outside diameter of 1 and ⅝ inches.

The collector 224 is made from a metallic material and is fixedly attached to the exhaust pipes 206, 208, 210, 212 by welding or other means known in the art.

FIGS. 2A through 2F illustrate an exhaust head pipe flange 214, 216, 218, 220 which is a component of the exhaust header 202 shown in FIG. 1. In the embodiment illustrated in FIG. 1, the exhaust header 202 comprises four exhaust head pipe flanges 214, 216, 218, 220. However, one who is skilled in the art will appreciate that the exhaust header 202 can incorporate more or less exhaust head pipe flanges depending on the number of cylinders in the cylinder bank. For example, in a multi-cylinder engine that comprises a total of six cylinders with three cylinders arranged in two opposing banks, the exhaust header 202 would comprise three exhaust head pipe flanges. Moreover, additional head pipe flanges can be incorporated into the exhaust header 202 when the multi-cylinder engine comprises more than eight cylinders.

Figures 2A, 2B, 2C, 2D, 2E, 2F:
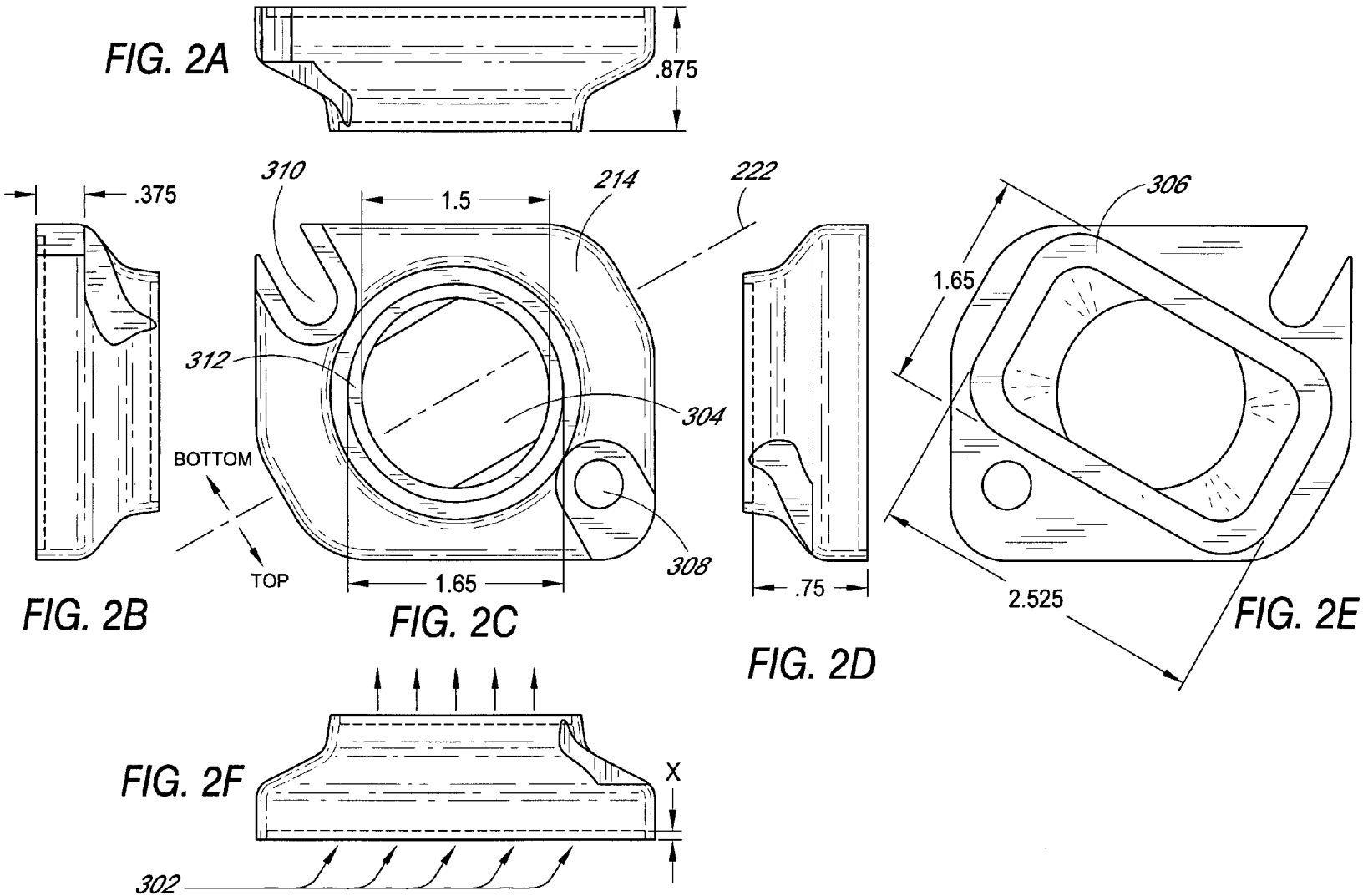
FIG. 2A is a side view of an exhaust head pipe flange that is a component of the exhaust header shown in FIG. 1.
FIG. 2B is a side view of the exhaust head pipe flange that is a component of the exhaust header shown in FIG. 1.
FIG. 2C is a back view of the exhaust head pipe flange taken from a location downstream of the exhaust head pipe flange.
FIG. 2D is a side view of the exhaust head pipe flange.
FIG. 2E is a front view of the exhaust head pipe flange taken from a location upstream of the exhaust head pipe flange.
FIG. 2F is a side view of the exhaust head pipe flange illustrating the flow direction of the exhaust gas through the exhaust pipe flange.

FIGS. 2A and 2B are side views of an exemplary exhaust head pipe flange 214. The exhaust head pipe 206 which forms a passageway together with the exhaust head pipe flange 214 is not shown in FIGS. 2A–2F. The following description applies equally to the exhaust head pipe flanges 216, 218, 220.

Preferably, the inner dimensions or shape of the passageway through the exhaust head pipe flange 214 is selected depending on the shape of the exhaust port at the exit plane of the cylinder head 204 and the inside diameter of the exhaust head pipe 206 that is fixedly attached to the exhaust head pipe flange 214. The shape of the passageway may increase or decrease along the length of the exhaust head pipe flange 214. In this way, the inner dimensions or shape can provide a smooth transition between the exhaust port and the inside diameter of the exhaust head pipe 206.

Moreover, the shape may increase in one dimension along the length of the exhaust head pipe flange 214 while a second dimension decreases along the length of the exhaust head pipe flange 214. For example, the exhaust head pipe flange 214 illustrated in FIGS. 2A–2F transitions or adapts a rectangular exit port to a circular exhaust head pipe 206. As illustrated in FIGS. 2A and 2B, a first inner dimension of the exhaust head pipe flange 214 increases along axis 222 in a downstream or exhaust flow direction. A second inner dimension measured perpendicular to the axis 222 decreases in a downstream direction. Even though the shape of the passageway through the embodiment illustrated in FIGS. 2A–2F varies along its length, the shape of the passageway through the exhaust head pipe flange 214 is not required to increase or decrease to practice the invention. An alternate embodiment of the exhaust head pipe flange 214 has a conical inner shape which connects a circular exhaust port to a larger circular exhaust head pipe 206.

FIG. 2C is a back view of the exhaust head pipe flange 214 taken from a location downstream of the exhaust head pipe flange 214. During fabrication of the exhaust header 202, the exhaust head pipe 206 is fixedly attached to the exhaust head pipe flange 214 on surface 312. Inside diameter 304 is selected to be equal to or less than the inside diameter of the exhaust head pipe 206 to prevent the exhaust head pipe 206 from protruding into the exhaust gas flow path 302 (see FIG. 2F). In this way, the inside diameter of the exhaust head pipe 206 and the inside diameter of the exhaust head pipe flange 214 form a smooth transition therebetween. In the preferred embodiment illustrated in FIG. 2C, the inside diameter of the exhaust head pipe flange 214 and the inside diameter of the surface 312 are 1.5 inches. The outside diameter of the surface 312 is 1.65 inches. In such a configuration, the exhaust head pipe 206 has a wall thickness of approximately $^{0.15}/_{2}$=0.075 inches. As shown in FIGS. 2A and 2D, the surface 312 can be approximately 0.75 inches from the upstream surface of the exhaust head pipe flange 214.

FIG. 2E is a front view of the exhaust head pipe flange 214 and illustrates a rectangular seal surface 306 which receives a gasket (not shown). However, the invention is not so limited. The seal surface 306 can have other shapes, for example, oblong, round or elliptical. The shape of the seal surface can be selected depending upon the exhaust port geometry of the cylinder head 204.

The seal surface 306 circumscribes the exhaust port of the cylinder head 204 (see FIG. 1). In the preferred embodiment, the seal surface 306 is recessed or inset into the exhaust head pipe flange 214. For example, as illustrated in FIG. 2F, the seal surface 306 is recessed a distance X from a mating or outer surface of the exhaust head pipe flange 214. Dimension X is selected depending on the thickness of the gasket that is placed against the seal surface 306. For example, dimension X can be selected so that when the gasket is placed against the seal surface 306 the gasket will protrude above the mating surface of the exhaust head pipe flange 214. In one embodiment, the dimension X is approximately 0.08 inches.

FIG. 2F is a side view of the exhaust head pipe flange illustrating the flow direction of the exhaust gas through the exhaust head pipe flange 214. The exhaust head pipe flange 214 further comprises bolt holes 308, 310. In the embodiment shown in FIG. 2C, the bolt holes 308, 310 are located on different sides of axis 222. Alternatively, more or less bolt holes could be incorporated in the exhaust head pipe flange 214 depending on the mating configuration of the surface 606 of the cylinder head 204. Moreover, one or more bolt holes could be further incorporated in the webs 232, 234, 236 (see FIG. 1) if corresponding bolt holes were provided in the cylinder head 204.

Figure 3A:
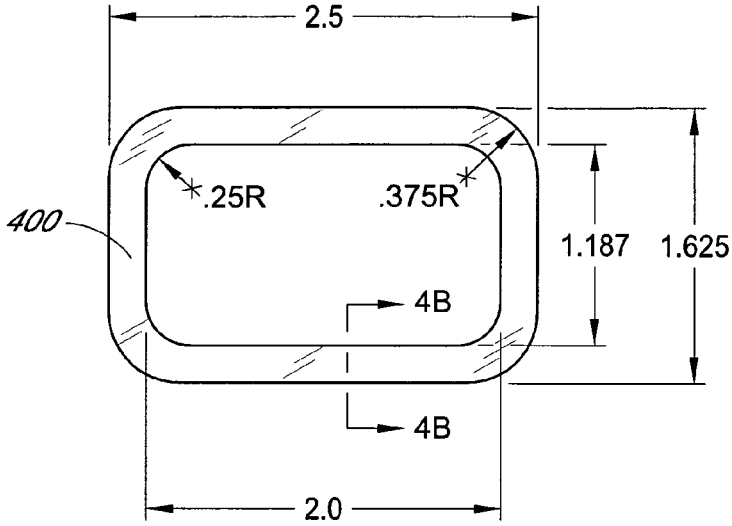
FIG. 3A is a front view of a gasket that is a component of the exhaust header shown in FIG. 1.

FIG. 3A is a front view of a gasket 400 that is a component of the exhaust header 202 shown in FIG. 1. Each exhaust head pipe flange 214, 216, 218, 220 is associated with its own gasket 400. Thus, the exhaust header 202 illustrated in FIG. 1 includes four gaskets 400. Each gasket 400 is placed against the seal surface 306 on each of the exhaust head pipe flanges 214, 216, 218, 220 prior to attaching the exhaust header 202 to the internal combustion engine 200. Once the exhaust header 202 is attached to the internal combustion engine 200, each gasket 400 is compressed between the exhaust head pipe flanges 214, 216, 218, 220 and the cylinder head 204.

Figure 3B:
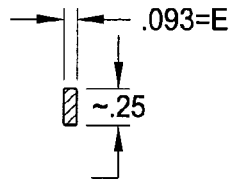
FIG. 3B is a cross-section view through the gasket shown in FIG. 3A.

As illustrated in FIG. 3B, the gasket can have a rectangular cross-sectional shape that matches the geometry of the seal surface 306. The gasket 400 is made from a graphite material or graphite composite. An exemplary gasket can be obtained from Seal Systems located in Santa Fe Springs, Calif., Part No. 46031N. One embodiment of the gasket 400 comprises metal-reinforced graphite with a 0.093 inch minimum thickness. Alternatively, the gasket 400 can have a cylindrical cross-sectional shape while still maintaining the overall rectangular shape as illustrated in FIG. 3A.

Dimension E in FIG. 3B illustrates the thickness of the gasket 400. Dimension E is selected to be greater than dimension X as illustrated in FIG. 2F. In this way, when the gasket 400 is placed against the seal surface 306 prior to attachment to the cylinder head 204, the gasket 400 will protrude above the mating or outer surface of the exhaust head pipe flange 214. During installation of the exhaust header 202 against the cylinder head 204, the gasket 400 is compressed sufficiently to provide a seal between the cylinder head 204, the gasket 400, and the seal surface 306. For example, the gasket 400 can be compressed approximately 0.010–0.015 inches by applying a torque of approximately 15–18 foot-lbs. to bolts 602, 604 during installation.

In a preferred embodiment, dimension E is 0.093 inches thick with the exhaust head pipe flange 214 dimension X being 0.080 inches deep. Advantageously, recessing a portion of the gasket 400 below the outer surface of the exhaust head pipe flange 214, 216, 218, 220 limits the amount of compression applied to the gasket 400 during installation. Limiting compression reduces the chance that the gasket 400 becomes pinched or non-uniformly deformed.

Figure 4:
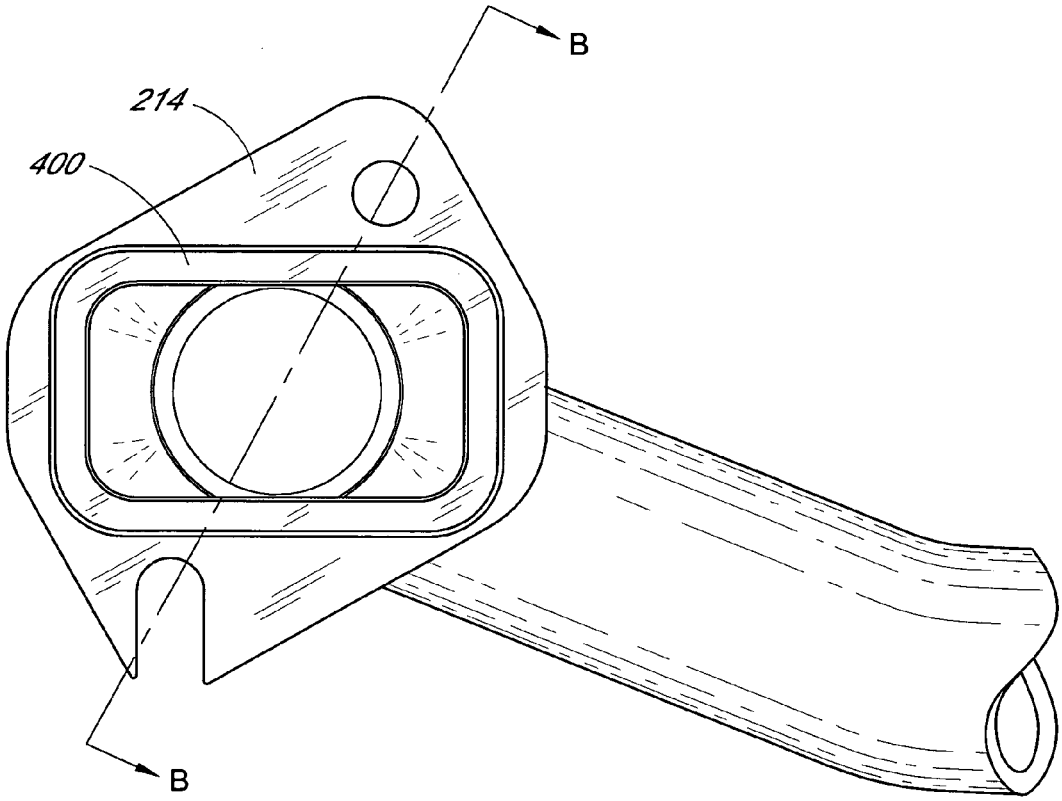
FIG. 4 is a front view of the exhaust head pipe flange connected to an exhaust head pipe and further comprising the gasket shown in FIG. 3A located against the seal surface shown in FIG. 2E.

FIG. 4 is a view looking downstream from the cylinder head 204 showing the gasket 400 placed against the seal surface 306 of the exhaust head pipe flange 214. The exhaust head pipe 206 is further shown attached to the downstream side of the exhaust head pipe flange 214.

Figure 5:
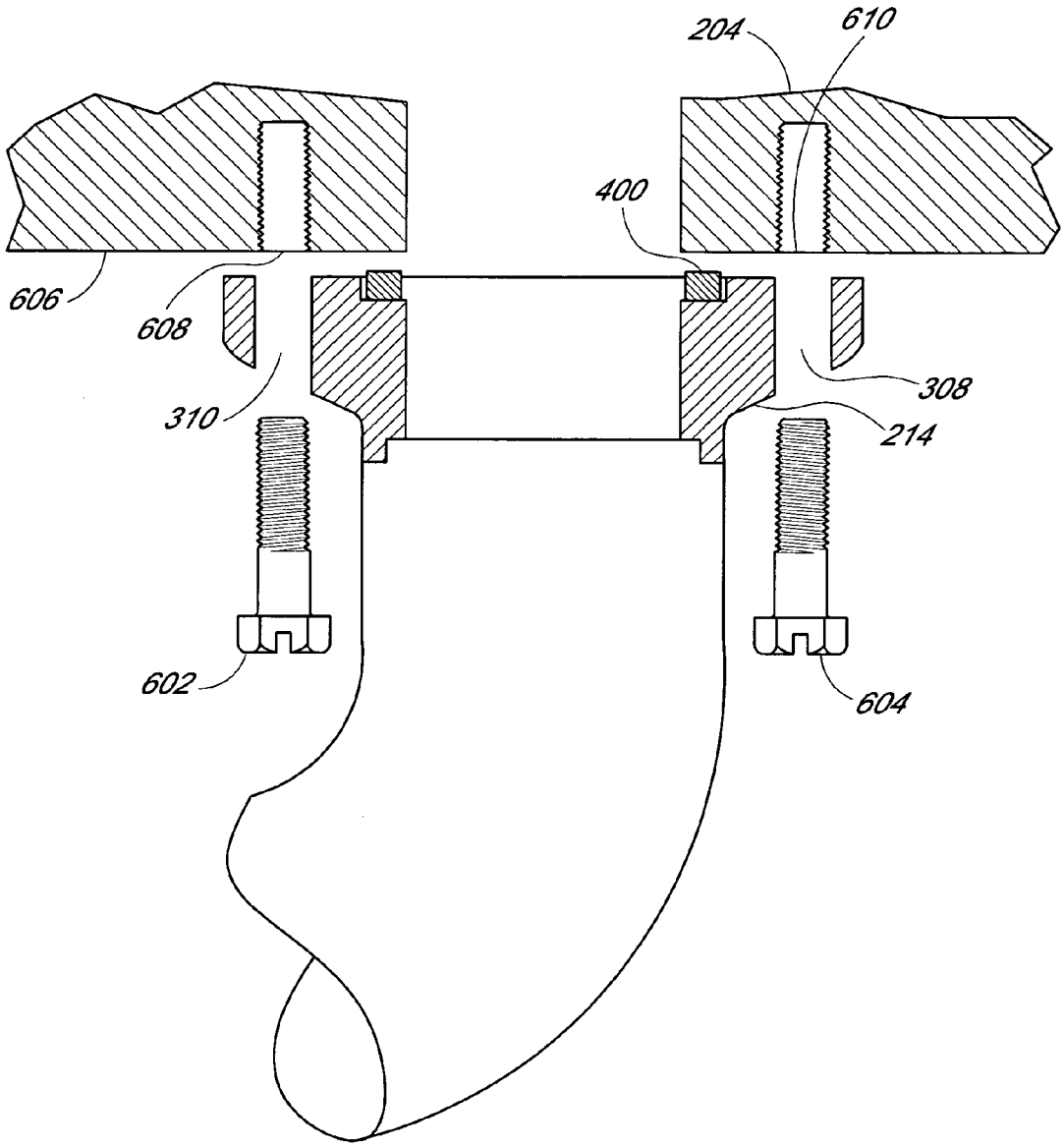
FIG. 5 is a section view of the assembled exhaust head pipe flange, exhaust pipe, and gasket from FIG. 4 being aligned with an exhaust port for attachment to the cylinder head with fasteners.

FIG. 5 is a cross-section view from FIG. 4 showing the exhaust head pipe flange 214, the exhaust head pipe 206, and gasket 400 prior to mating with the interface surface 606 of the cylinder head 204. Gasket 400 is disposed between the interface surface 606 of the cylinder head 204 and the seal surface 306 of the exhaust head pipe flange 214 with the gasket 400 opening in general coaxial registration with the corresponding exhaust gas passageway from the internal combustion engine 200.

As illustrated in FIG. 5, the gasket 400 protrudes beyond the outer or mating surface of the exhaust head pipe flange 214. Bolts or fasteners 602, 604 are used to apply a compressive load between the exhaust head pipe flange 214 and the cylinder head 204. Upon the tightening of the bolts 602, 604 to a predetermined torque, the gasket 400 is compressed between the interface surface 606 to a thickness that is less than the original thickness of the gasket 400. The compressive load forms a seal between the gasket 400 and the cylinder head 204 as well as between the gasket 400 and the seal surface 306. In this regard, as the gasket 400 of the present invention is compressed under the torque of the bolts or other fastening members, it affects a fluid tight seal of the corresponding fluid passageways of the exhaust head pipe flange and cylinder head. That is, the gasket 400 exhibits a reduced-yield stress as compared to the exhaust head pipe flange 214 and, accordingly, is deformable for conforming to any irregularities between the interface surfaces of the cylinder head 204. As a given compressive load is applied by the tightening of the bolts 602, 604 which fasten the interface surfaces of the exhaust head pipe flange 214, an increased bearing stress is provided about the fluid passageways of the cylinder head 204 by virtue of the reduced surface area contact of the gasket 400 on the interface surface 606 of the cylinder head 204.

Additionally, defined within the interface surface 606 are a plurality of bores, two of which are referenced at 608, 610 for exhaust head pipe flange 214. Each of the bores of each exhaust head pipe flange 214, 216, 218, 220 is aligned with a corresponding bore or bolt hole in the cylinder head 204 to define a hole configured to receive an associated bolt or fastening member. The associated fasteners are illustrated as a threaded bolts 602, 604. Bolts 602, 604 connect the exhaust head pipe flange 214, 216, 218, 220 and are tightened to a predetermined torque to affect the compression of gasket 400 in a sealing engagement between the interface surface 606 and the exhaust head pipe flange. The two threaded bolts associated with one exhaust head pipe flange can be torqued independent of the threaded fasteners associated with the other exhaust head pipe flanges. Alternatively, the threaded bolts associated with a plurality of exhaust head pipe flanges are torqued in series to evenly distribute the compressive load across the entire exhaust header 202.

The various embodiments of the exhaust header and techniques described above thus provide a number of ways to provide a fluid tight and releasable seal between the exhaust header and an engine. The combination of separate gaskets, individual recesses, and graphite material provides a more robust seal between the engine block and the exhaust header. For example, the recesses provide additional lateral support to the gaskets. The recesses further limit the amount of compression experienced by the gaskets during assembly of the exhaust manifold to the engine. This additional support and the limits on compression allow a gasket material that has limited flexibility to be utilized.

For example, these features enhance the longevity of a graphite gasket located within the recess. Without the additional lateral support, a substantial core material may need to be incorporated into the graphite gasket to help the graphite gasket maintain its shape under high exhaust gas pressure. However, a substantial core material may expand at a different rate than the graphite material and lead to degradation of the seal over time.

The use of multiple gaskets for the exhaust header allows each gasket to be individually seated against the engine. Movement or shifting during assembly or engine operation does not affect adjacent gaskets of the exhaust header. In this way, the location of each gasket can be individually optimized during assembly and engine operation to provide a more robust seal between all of the gaskets of the exhaust header and the engine.

Of course, it is to be understood that not necessarily all such objectives or advantages may be achieved in accordance with any particular embodiment using the exhaust systems described herein. Thus, for example, those skilled in the art will recognize that the systems may be developed in a manner that achieves or optimizes one advantage or group of advantages as taught herein without necessarily achieving other objectives or advantages as may be taught or suggested herein. In addition, the techniques described may be broadly applied for use with a variety of engines and exhaust systems.

Furthermore, the skilled artisan will recognize the interchangeability of various features from different embodiments. Although these techniques and systems have been disclosed in the context of certain embodiments and examples, it will be understood by those skilled in the art that these techniques and systems may be extended beyond the specifically disclosed embodiments to other embodiments and/or uses and obvious modifications and equivalents thereof. Thus, it is intended that the scope of the systems disclosed herein disclosed should not be limited by the particular disclosed embodiments described above.

What is claimed is:

1. An exhaust header for collecting exhaust gases from an internal combustion engine, the exhaust header comprising:

a plurality of flanges, each having a recessed sealing surface that is configured to circumscribe an exhaust port on an internal combustion engine, wherein the recessed sealing surface is configured so as to support therein a gasket in a manner such that at least a portion of the gasket is exposed to gas flowing out the exhaust port;

a web connecting at least two of the plurality of flanges;

a plurality of gaskets comprising graphite, each located in the recessed sealing surface and configured to form separate seals between each flange and the engine around the exhaust port;

a plurality of head pipes in flow communication with the plurality of flanges and configured to route exhaust gases from the plurality of flanges; and a collector having a plurality of inlet ports connected to the plurality of head pipes.

2. The exhaust header of claim 1, wherein the flange comprises two bolt holes.

3. The exhaust header of claim 2, wherein one of the two bolt holes is open to an edge of the flange.

4. The exhaust header of claim 1, wherein the flange comprises a chamfered inside surface so as to provide a transition between an inner surface of the flange and an inside diameter of the head pipe.

5. The exhaust header of claim 1, wherein a depth of the recessed sealing surface is approximately 0.1 inches.

6. The exhaust header of claim 1, wherein the recessed sealing surface has a substantially circular shape.

7. The exhaust header of claim 1, wherein the recessed sealing surface has a substantially rectangular shape.

8. The exhaust header of claim 7, wherein the graphite gasket comprises metal reinforcement.

9. The exhaust header of claim 1, wherein the graphite gasket has a melting temperature of at least 2000 degrees Fahrenheit.

10. A method for installing an exhaust header to a substantially flat surface of a multi-cylinder engine, the exhaust header having a plurality of exhaust pipes, each exhaust pipe being configured to collect exhaust gas from a cylinder of the multi-cylinder engine, the method comprising:

providing an exhaust header having a plurality of flanges and at least one web, each flange having a recessed sealing surface, the sealing surface being configured so as to support therein a gasket in a manner such that at least a portion of the gasket is exposed to gas flowing out the exhaust port, the web connecting at least two of the plurality of flanges, wherein the sealing surface circumscribes an exhaust port from the cylinder;

placing a graphite gasket against each sealing surface in the plurality of flanges;

abutting each graphite gasket against a substantially flat surface of the multi-cylinder engine; and individually compressing each graphite gasket against the substantially flat surface of the multi-cylinder engine so as to form a plurality of separate seals between the plurality of flanges and the substantially flat surface.

11. The method of claim 10, wherein the graphite gasket protrudes beyond an outer surface of the flange.

* * * * *